US009519272B2

(12) United States Patent
Kobayashi et al.

(10) Patent No.: US 9,519,272 B2
(45) Date of Patent: Dec. 13, 2016

(54) WRISTWATCH

(71) Applicant: CASIO COMPUTER CO., LTD., Shibuya-ku, Tokyo (JP)

(72) Inventors: Kazuma Kobayashi, Fuchu (JP); Yoshihiro Maruyama, Hamura (JP); Junichi Sato, Hino (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/839,728

(22) Filed: Aug. 28, 2015

(65) Prior Publication Data

US 2016/0124390 A1 May 5, 2016

(30) Foreign Application Priority Data

Nov. 5, 2014 (JP) ..... 2014-224918

(51) Int. Cl.
*G04B 37/14* (2006.01)
*A44C 5/14* (2006.01)

(52) U.S. Cl.
CPC ..... *G04B 37/1486* (2013.01); *A44C 5/14* (2013.01)

(58) Field of Classification Search
CPC ..... G04B 337/14; G04B 7/1486; G04B 37/14; G04B 37/1486; A44C 5/14
See application file for complete search history.

(56) References Cited

U.S. PATENT DOCUMENTS 4,722,179 A * 2/1988 Tesch ..... A44C 5/14 16/379
4,928,504 A * 5/1990 Tuppini ..... A44C 5/107 59/82
5,197,274 A 3/1993 Braun
6,098,394 A * 8/2000 Hashimoto ..... A44C 5/10 59/80
6,130,862 A * 10/2000 Upton ..... G04B 37/1486 368/282
6,564,540 B2 * 5/2003 Greguitch ..... A44C 5/107 59/78
2009/0225633 A1 * 9/2009 Lepine ..... G04B 37/1486 368/282

FOREIGN PATENT DOCUMENTS

JP 10113205 A 5/1998
JP 2002112811 A 4/2002
JP 2007089882 A 4/2007

OTHER PUBLICATIONS

Japanese Office Action (and English translation thereof) dated Aug. 4, 2016, issued in counterpart Japanese Application No. 2014-224918.

* cited by examiner

*Primary Examiner* — Vit W Miska
(74) *Attorney, Agent, or Firm* — Holtz, Holtz & Volek PC

(57) ABSTRACT

A wristwatch including a case including a band attachment section having an attachment hole, a band including a coupling hole in one end portion located coaxially with the attachment hole of the band attachment section, a coupling member inserted into the coupling hole of the band and the attachment hole of the band attachment section and coupling the band with the band attachment section, and a fixing member fixing the coupling member to the attachment hole of the band attachment section or the coupling hole of the band.

15 Claims, 5 Drawing Sheets

WRISTWATCH

CROSS-REFERENCE TO RELATED APPLICATION

This application is based upon and claims the benefit of priority from the prior Japanese Patent Application No. 2014-224918, filed Nov. 5, 2014, the entire contents of which are incorporated herein by reference.

BACKGROUND OF THE INVENTION

1. Field of the Invention

The present invention relates to a wristwatch.

2. Description of the Related Art

For example, a band attachment structure of a wristwatch is known in which one end portion of a watch band is arranged between band attachment sections of a wristwatch case and, in this state, attached to the band attachment sections by a coupling member such as a spring rod, as described in Japanese Patent Application Laid-Open (Kokai) Publication No. 2007-089882.

The coupling member of this type of band attachment structure includes a pipe arranged in an attachment hole provided in the end portion of the watch band, and pin sections are retractably arranged in both end portions of the pipe, respectively. The pin sections are pressed outward by the spring force of a coil spring arranged in the pipe, and the end portion of the watch band is attached to the band attachment sections by the tip end portions of the pressed pin portions being resiliently inserted into engaging holes of the band attachment sections.

However, in this band attachment structure where the tip end portions of the pin sections pushed out by the spring force of the coil spring are resiliently inserted into the engaging holes of the band attachment section from both end portions of the pipe arranged in the attachment hole provided in the end portion of the watch band, when the wristwatch case receives a strong shock by being dropped or the like, the tip end portion of the pin section is detached from the engaging hole of the band attachment section or the pin section is bent, and the end portion of the watch band is detached from the band attachment section in some cases.

The present invention is a wristwatch whose coupling member is not loosened and detached by shock.

SUMMARY OF THE INVENTION

In accordance with one aspect of the present invention, there is provided a wristwatch comprising: a case including a band attachment section having an attachment hole; a band including a coupling hole in one end portion located coaxially with the attachment hole of the band attachment section; a coupling member inserted into the coupling hole of the band and the attachment hole of the band attachment section and coupling the band with the band attachment section; and a fixing member fixing the coupling member to the attachment hole of the band attachment section or the coupling hole of the band.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

First Embodiment

Hereafter, a first embodiment in which the present invention has been applied in a wristwatch will be explained with reference to FIG. 1 to FIG. 3.

Figure 1:
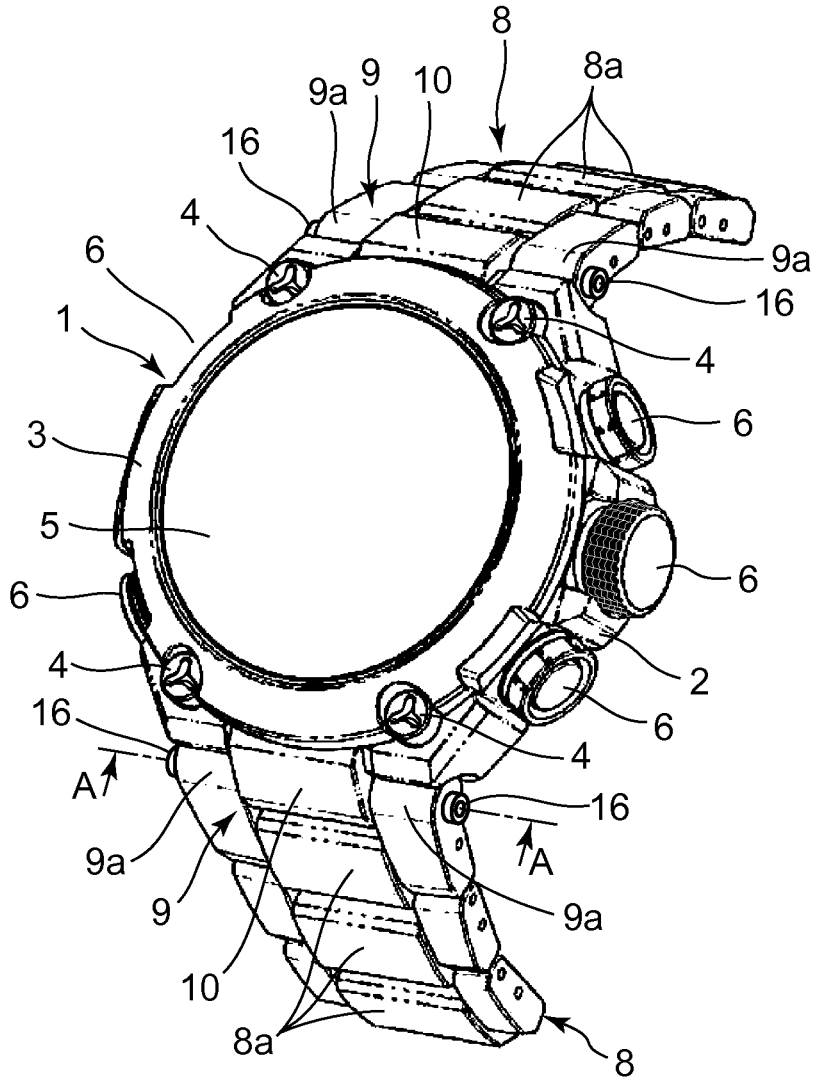
FIG. 1 is an enlarged perspective view showing a first embodiment in which the present invention has been applied in a wristwatch.

This wristwatch is provided with a wristwatch case 1, as shown in FIG. 1. The wristwatch case 1 is constituted by a main-body case 2 and an exterior case 3. In this case, the main-body case 2 and the exterior case 3 are formed of a metal such as a titanium alloy or a stainless steel. The exterior case 3, which has a substantially ring shape in its entirety, is arranged at an upper outer peripheral portion of the main-body case 2, and attached to the main-body case 2 in this state by screws 4.

As shown in FIG. 1, a timepiece glass 5 is attached to the upper opening of the wristwatch case 1, that is, the upper opening of the main-body case 2, and a back cover (not shown) is attached to a lower portion of the wristwatch case 1. Moreover, a timepiece module (not shown) is provided in the wristwatch case 1. Switch buttons 6 are provided respectively on lateral-surface portions on the two o'clock side, three o'clock side, four o'clock side, eight o'clock side, and ten o'clock side of the wristwatch case 1.

Furthermore, on the twelve o'clock side and six o'clock side of the wristwatch case 1, band attachment sections 10 to which end portions 9 of a watch band 8 are attached are provided, respectively, as shown in FIG. 1. The band attachment section 10 is a rectangular projecting portion, which is provided projecting from a lateral surface of the main-body case 2 of the wristwatch case 1, and an attachment hole 11 is linearly provided in a direction along the outer periphery of the main-body case 2.

The watch band 8 is structured to sequentially rotatably couple a plurality of band pieces 8*a* made of metal, as shown in FIG. 1. The band piece 8*a* positioned at the end portion 9 of the watch band 8 is structured such that a pair of coupling end sections 9*a* positioned in the direction orthogonal to the longitudinal direction of the watch band 8 straddle the band attachment section 10 and are arranged on both sides thereof. As shown in FIG. 2 and FIG. 3, coupling holes 12 are correspondingly provided on the same axis as the attachment hole 11 of the band attachment section 10 respectively in the pair of coupling end sections 9*a* positioned at the end portion 9 of the watch band 8.

Figure 2:
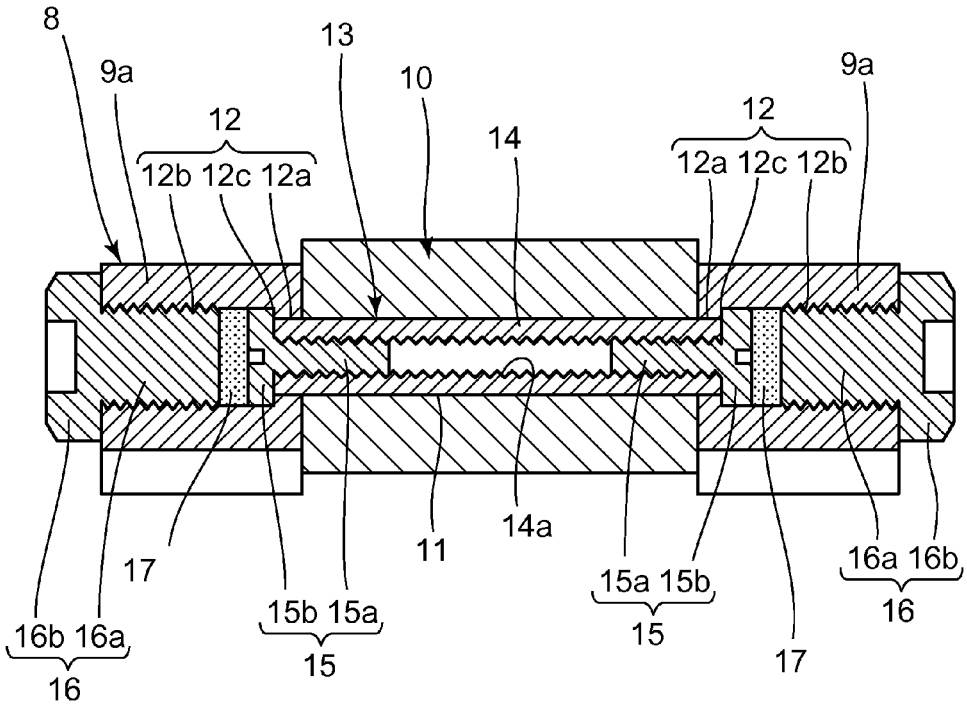
FIG. 2 is an enlarged cross-sectional view of the main portion of the wristwatch taken along line A-A in FIG. 1.
Figure 3:
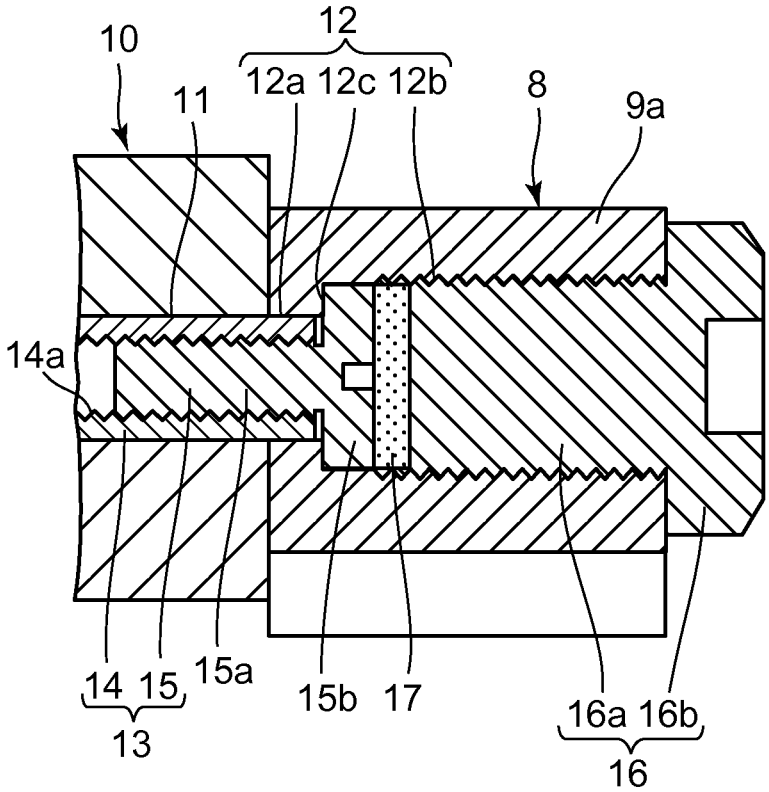
FIG. 3 is an enlarged cross-sectional view of the main portion of a band attachment structure shown in FIG. 2.

The watch band 8 is structured to be attached to each of the band attachment sections 10 by a coupling member 13, which is inserted into the coupling holes 12 of the pair of coupling end sections 9*a* provided at the end portions 9 thereof and an attachment hole 11 provided in the band attachment section 10, as shown in FIG. 2 and FIG. 3. The coupling member 13 is provided with a pipe section 14 that is a tubular member, and a pair of screw members 15 attached to the pipe section 14.

The pipe section 14 is formed of a metal such as a titanium alloy or a stainless steel. As shown in FIG. 2 and FIG. 3, a female screw 14*a* is provided on the inner peripheral surface of the pipe section 14. The pipe section 14 is formed such that the axial-direction length thereof is longer than the axial-direction length of the attachment hole 11 of the band attachment section 10 and is shorter than the axial-direction total length of both of the coupling holes 12 of the pair of coupling end sections 9*a* of the end portion 9 of the watch band 8 and the attachment hole 11 of the band attachment section 10 positioned between the pair of coupling end sections 9*a*.

As a result, the pipe section 14 is structured such that, when the pipe section 14 is arranged in the attachment hole 11 of the band attachment section 10, both end portions of the pipe section 14 are inserted into the coupling holes 12 of the pair of coupling end sections 9*a* of the end portions 9 of the watch band 8, and arranged respectively at portions on the rear side in the coupling holes 12, that is, on the band attachment section 10 side, as shown in FIG. 2 and FIG. 3.

As shown in FIG. 2 and FIG. 3, each of the pair of screw members 15 has a male screw 15*a* that is screwed into the female screw 14*a* in the pipe section 14, and a head section 15*b* that is larger than the outer diameter of the pipe section 14. More specifically, each of the head sections 15*b* of the pair of screw members 15 is formed such that the outer diameter thereof is larger than the outer diameter of the pipe section 14. Therefore, each of the coupling holes 12 of the watch band 8 has a small-diameter hole section 12*a* into which the pipe section 14 is inserted and a large-diameter hole section 12*b* into which the head section 15*b* of the screw member 15 is inserted.

In this case, the small-diameter hole section 12*a* of each coupling hole 12 is provided on the inner end portion side on the band attachment section 10 side, and the large-diameter hole section 12*b* of the coupling hole 12 is provided on the outer end portion side distant from the band attachment section 10, as shown in FIG. 2 and FIG. 3. Therefore, in each coupling hole 12, a step section 12*c* is formed at a boundary portion between the small-diameter hole section 12*a* and the large-diameter hole section 12*b*. Moreover, the axial-direction length of the small-diameter hole section 12*a* is formed to be a length sufficiently shorter than the axial-direction length of the large-diameter hole section 12*b*, such as a length that is about one fourth of the axial-direction length of the large-diameter hole section 12*b*.

As a result, the pair of screw members 15 is structured such that, when the male screws 15*a* are screwed into the female screws 14*a* from both sides of the pipe section 14 through the large-diameter hole sections 12*b* of the coupling holes 12 with the pipe section 14 being arranged in the attachment hole 11 of the band attachment section 10 and both end portions of the pipe sections 14 being arranged in the small-diameter hole sections 12*a* of the coupling holes 12 of the watch band 8, the head sections 15*b* come close to or come in contact with both end portions of the pipe section 14 and are pressed against the step sections 12*c* of the coupling holes 12, as shown in FIG. 2 and FIG. 3.

Accordingly, the pair of screw members 15 is structured such that, when the screw members 15 are tightened with the head sections 15*b* being positioned close to or in contact with both end portions of the pipe section 14 and being pressed against the step sections 12*c* of the coupling holes 12, the screw members 15 fix the pipe section 14 in the attachment hole 11 of the band attachment section 10 and in the small-diameter hole sections 12*a* of the coupling holes 12 without rattling and press the pair of coupling end sections 9*a* of the watch band 8 against both end portions of the band attachment section 10, as shown in FIG. 2 and FIG. 3.

Also, as shown in FIG. 2 and FIG. 3, a pair of fixing screws 16 (fixing members) is attached to the coupling holes 12 of the watch band 8. That is, each of the large-diameter hole sections 12*b* of the coupling holes 12 is formed into a screw hole. Each of the pair of fixing screws 16 has a screw section 16*a* that is screwed into the large-diameter hole section 12*b* of the coupling hole 12, and a head section 16*b* that comes in contact with the outer end surface of each of the pair of coupling end sections 9*a* provided at the end portion 9 of the watch band 8.

As a result, the pair of fixing screws 16 is structured to fix the coupling member 13 in the attachment hole 11 of the band attachment section 10 and in the coupling holes 12 by pressing the head sections 16*b* respectively against the outer end surfaces of the pair of coupling end sections 9*a* of the watch band 8 when the screw sections 16*a* are screwed into the large-diameter hole sections 12*b* of the coupling holes 12 and tightened, as shown in FIG. 2 and FIG. 3.

In this embodiment, as shown in FIG. 2 and FIG. 3, buffers 17 are arranged respectively between the pair of fixing screws 16 and the end portions of the coupling member 13. These buffers 17 are formed of a material having elasticity such as an urethane resin, a silicone resin, or an elastomer, and have a substantially disk shape. The buffer 17 is arranged between the head section 15*b* of the screw member 15 of the coupling member 13 and a tip end portion of the screw section 16*a* of the fixing screw 16.

As a result, the buffers 17 are structured such that, when the screw sections 16*a* of the fixing screws 16 are screwed into the large-diameter hole sections 12*b* of the coupling holes 12 and the head sections 16*b* are pressed against the outer end surfaces of the pair of coupling end sections 9*a* of the watch band 8, the buffers 17 are resiliently pressed against the head sections 15*b* of the screw members 15 of the coupling member 13 by the tip end portions of the screw sections 16*a* of the fixing screws 16, as shown in FIG. 2 and FIG. 3.

Next, effects of the band attachment structure of this wristwatch are described.

When the watch band 8 is to be attached to the band attachment section 10 of the wristwatch case 1, first, the end portions 9 of the watch band 8 are arranged at the band attachment section 10. Here, the pair of coupling end sections 9*a* provided at the end portions 9 of the watch band 8 are arranged on both sides of the band attachment section 10 to cause the coupling holes 12 provided in the pair of coupling end sections 9*a* to coaxially correspond to the attachment hole 11 of the band attachment section 10.

In this state, the pipe section 14 of the coupling member 13 is inserted into the attachment hole 11 of the band attachment section 10 from the coupling hole 12 of one of the pair of coupling end sections 9*a*, and both end portions of the pipe section 14 are arranged in the small-diameter hole sections 12*a* of the coupling holes 12 provided in the pair of coupling end sections 9*a*. As a result, the end portions 9 of the watch band 8 are rotatably coupled to the band attachment section 10 by the pipe section 14.

In this state, the pair of screw members 15 is respectively inserted into the coupling holes 12 of the pair of coupling end sections 9*a*, and each of the male screws 15*a* of the pair of screw members 15 is screwed into the female screw 14*a* of the pipe section 14 and tightened. As a result, the head sections 15*b* of the pair of screw members 15 are pressed against the step sections 12*c* of the coupling holes 12 with the head sections 15*b* being positioned close to or in contact with both end portions of the pipe section 14.

As a result, the pipe section 14 is fixed in the attachment hole 11 of the band attachment section 10 and the small-diameter hole sections 12*a* of the coupling holes 12 without rattling, and the pair of coupling end sections 9*a* is pressed against both end portions of the band attachment section 10. In this state, each of the head sections 15*b* of the pair of screw members 15 is arranged at a substantially intermediate portion on the band attachment section 10 side in the large-diameter hole section 12*b* of the coupling hole 12 provided in each of the pair of coupling end sections 9*a*. Moreover, in this state, the end portions 9 of the watch band 8 are attached to the band attachment section 10 such that they are rotatable around the pipe section 14.

Then, the buffers 17 are arranged respectively in the large-diameter hole sections 12*b* in the coupling holes 12 of the pair of coupling end sections 9*a* and, in this state, the screw sections 16*a* of the pair of fixing screws 16 are respectively screwed into the large-diameter hole sections 12*b* and tightened. As a result, the head sections 16*b* of the pair of fixing screws 16 are pressed against the outer end surfaces of the pair of coupling end sections 9*a* of the watch band 8, and the buffers 17 are pressed respectively against the head sections 15*b* of the pair of screw members 15 which are positioned at both end portions of the coupling member 13, by the tip end portions of the screw sections 16*a* of the pair of fixing screws 16.

Since the buffers 17 have been resiliently pressed against each head sections 15*b* of the pair of screw members 15 of the coupling member 13 respectively by the screw sections 16*a* of the pair of fixing screws 16, even when the fixing screws 16 are loosened due to shock applied to the attachment portion of the watch band 8 with respect to the wristwatch case 1, the screw members 15 are not loosened because of the buffers 17. As a result, the watch band 8 is reliably and firmly attached to the band attachment section 10 of the wristwatch case 1 by the coupling member 13.

In this state, when the end portions 9 of the watch band 8 are rotated with respect to the band attachment section 10 of the wristwatch case 1, the end portions 9 of the watch band 8 are rotated around the pipe section 14 of the coupling member 13. Accordingly, the pair of screw members 15 is not loosened by friction between the attachment hole 11 of the band attachment section 10 and the pipe section 14 occurred along with this rotation. Therefore, the watch band 8 is rotatably attached to the band attachment section 10 of the wristwatch case 1 reliably and firmly by the coupling member 13.

As such, the band attachment structure of this wristwatch includes the wristwatch case 1 having the band attachment sections 10 provided with the attachment holes 11, the watch band 8 provided with the coupling holes 12 which are in the end portions 9 and on the same axis as the attachment hole 11 of the band attachment section 10, the coupling member 13 inserted into the coupling holes 12 of the watch band 8 and the attachment hole 11 of the band attachment section 10 and coupling the watch band 8 to the band attachment section 10, and the fixing screws 16 fixing the coupling member 13 in the coupling holes 12 of the watch band 8. Accordingly, the coupling member 13 is prevented from being loosened and detached by shock, and the watch band 8 can be reliably and firmly attached to the band attachment section 10 by the coupling member 13.

That is, in the band attachment structure of the wristwatch, even when the attachment portion of the watch band 8 with respect to the wristwatch case 1 receives shock, the coupling member 13 is prevented from being loosened and detached from the band attachment section 10 of the wristwatch case 1 and the end portions 9 of the watch band 8 because the coupling member 13 has been fixed by the fixing screws 16. Therefore, the end portions 9 of the watch band 8 can be reliably and firmly attached to the band attachment section 10 by the coupling member 13.

In the band attachment structure of the wristwatch in this embodiment, even if the increase of the size of the display surface of the wristwatch, that is, face widening is desired, and whereby the sizes of the wristwatch case 1 and the watch band 8 and the weight of the entire wristwatch are increased and impact force caused by the wristwatch being dropped or the like is increased, the coupling member 13 is prevented from being loosened and detached by the increased impact force. Therefore, even when the sizes of the wristwatch case 1 and the watch band 8 are increased, the watch band 8 can be reliably and firmly attached to the band attachment section 10 by the coupling member 13.

In this embodiment, the end portions 9 of the watch band 8 are provided with the pair of coupling end sections 9*a* arranged on both sides of the band attachment section 10 of the wristwatch case 1 such that they straddle the band attachment section 10, and the pair of coupling end sections 9*a* is structured to be provided with the coupling holes 12, respectively. Therefore, when the fixing screws 16 are respectively attached to the coupling holes 12 of the pair of coupling end sections 9*a*, the coupling member 13 can be reliably fixed by the fixing screws 16 such that the pair of coupling end sections 9*a* is not pressed and widened.

Moreover, in the band attachment structure, the coupling member 13 includes the pipe section 14 that is a tubular member provided with the female screw 14*a* on the inner peripheral surface and inserted into the coupling holes 12 of the watch band 8 and the attachment hole 11 of the band attachment section 10, and the pair of screw members 15 that has the male screws 15*a* screwed into the female screw 14*a* of the pipe section 14 and the head sections 15*b* larger than the outer diameter of the pipe section 14. Therefore, the end portions 9 of the watch band 8 can be easily and reliably attached to the band attachment section 10.

That is, with the coupling member 13, the end portions 9 of the watch band 8 and the band attachment section 10 can be easily rotatably coupled only by inserting the pipe section 14 into the coupling holes 12 of the watch band 8 and the attachment hole 11 of the band attachment section 10. By inserting the screw members 15 into the coupling holes 12 of the watch band 8 in this state and screwing the male screws 15*a* into the female screw 14*a* of the pipe section 14, the pipe section 14 can be reliably and firmly fixed by the head sections 15*b*.

Accordingly, the end portions 9 of the watch band 9 can be rotated around the pipe section 14 when the end portions 9 of the watch band 8 are rotated with respect to the band attachment section 10. Therefore, even when friction is generated at the attachment hole 11 of the band attachment section 10 and the pipe section 14 along with the rotation, the screw members 15 are prevented from being loosened by the pipe section 14, and the end portions 9 of the watch band 8 can be rotatably attached to the band attachment section 10 reliably.

In this embodiment, each of the coupling holes 12 of the pair of coupling end sections 9*a* provided in the end portions 9 of the watch band 8 has the small-diameter hole section 12*a* into which the pipe section 14 is inserted and the large-diameter hole section 12*b* into which the head section 15*b* of the screw member 15 is inserted. Accordingly, the step sections 12*c* are provided at the boundary portions between the small-diameter hole sections 12*a* and the large-diameter hole sections 12*b*, and the head sections 15*b* of the screw members 15 are pressed against the step sections 12*c*. As a result, the coupling member 13 can be reliably and firmly fixed in the coupling holes 12 of the watch band 8 and the attachment hole 11 of the band attachment section 10.

That is, the coupling member 13 can firmly tighten the screw members 15 with the pipe section 14 by the head sections 15*b* of the pair of screw members 15 being pressed against the step sections 12*c* of the pair of coupling holes 12 when the pair of screw members 15 is inserted respectively into the coupling holes 12 of the pair of coupling end sections 9*a* and the male screws 15*a* of the pair of screw members 15 are screwed into the female screws 14*a* of the pipe section 14 and tightened.

Therefore, the pipe section 14 can be reliably and firmly fixed in the attachment hole 11 of the band attachment section 10 and the small-diameter hole sections 12*a* of the coupling holes 12 without rattling, and the pair of coupling end sections 9*a* of the watch band 8 can be pressed against both end portions of the band attachment section 10. As a result, the pair of coupling end sections 9*a* of the watch band 8 is prevented from being pressed and widened by shock and the watch band 8 can be reliably and firmly attached to the band attachment section 10.

Also, in this band attachment structure, the pair of fixing screws 16 is screwed into the coupling holes 12 of the pair of coupling end sections 9*a* positioned in the end portions 9 of the watch band 8 along the axial direction thereof and the coupling member 13 is fixed. Therefore, even when the pair of screw members 15 is loosened with respect to the pipe section 14 of the coupling member 13 when shock is received, the pair of fixing screws 16 can prevent the pair of screw members 15 from falling off the pipe section 14. As a result, the watch band 8 can be prevented from unintentionally detached from the band attachment sections 10.

In this embodiment, the buffers 17 are respectively arranged between the pair of fixing screws 16 and both end portions of the coupling member 13. Accordingly, when the screw sections 16*a* of the pair of fixing screws 16 are respectively screwed into the large-diameter hole sections 12*b* of the coupling holes 12 in the pair of coupling end sections 9*a* and tightened, the buffers 17 can be respectively pressed resiliently against the head sections 15*b* of the pair of screw members 15 by the tip end portions of the screw sections 16*a* of the pair of fixing screws 16.

Therefore, even if the pair of fixing screws 16 is loosened due to shock received by the attachment portion of the watch band 8 with respect to the wristwatch case 1, the buffers 17 can prevent the pair of screw members 15 of the coupling member 13 from being loosened. As a result, the end portions 9 of the watch band 8 can be more reliably and firmly attached to the band attachment sections 10 of the wristwatch case 1 by the coupling member 13.

Second Embodiment

Next, a second embodiment in which the present invention has been applied in a wristwatch is described with reference to FIG. 4 and FIG. 5. Note that sections identical to those of the first embodiment shown in FIG. 1 to FIG. 3 are provided with the same reference numerals.

Figure 4:
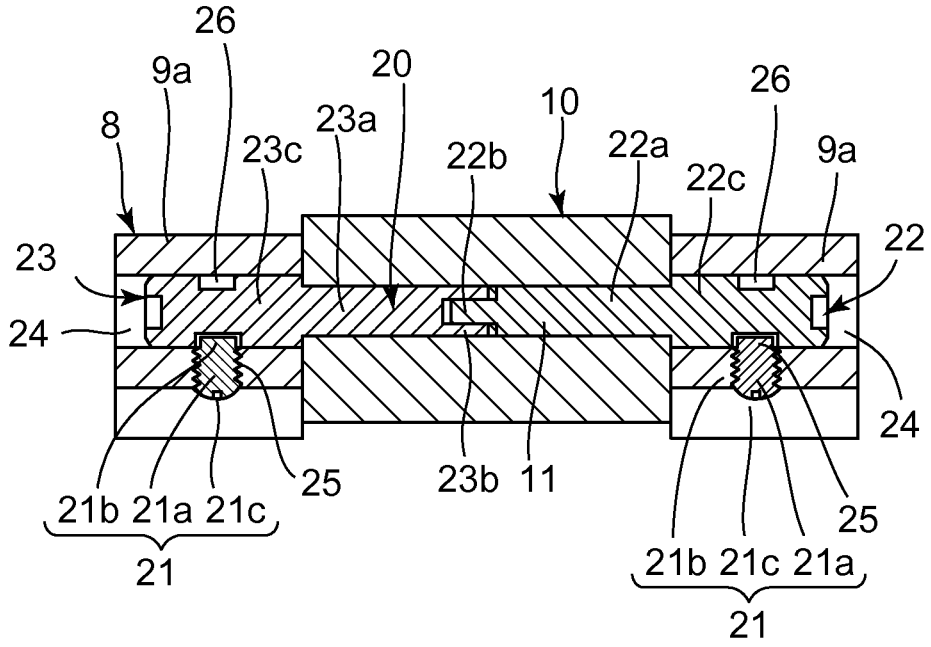
FIG. 4 is an enlarged cross-sectional view of the main portion of a second embodiment in which the present invention has been applied in a wristwatch.
Figure 5:
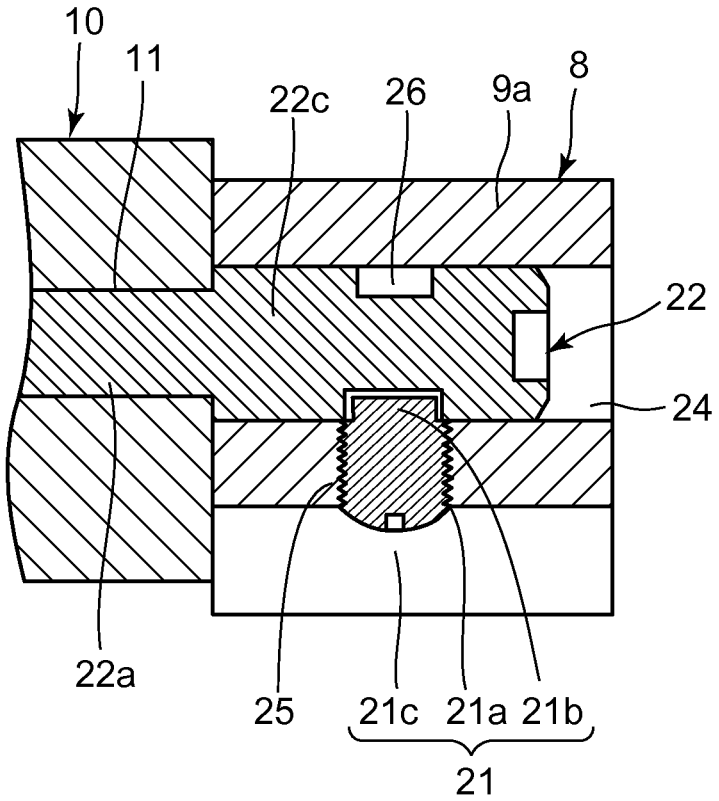
FIG. 5 is an enlarged cross-sectional view of the main portion of a band attachment structure shown in FIG. 4.

As shown in FIG. 4 and FIG. 5, the structure of this wristwatch is substantially the same as that of the first embodiment except that a coupling member 20 and a pair of fixing screws 21 (fixing members) are different from those of the first embodiment.

The coupling member 20 is provided with a first screw member 22 and a second screw member 23, as shown in FIG. 4 and FIG. 5. The first screw member 22 has a first shaft section 22*a*, a male screw section 22*b* provided at one end portion of the first shaft section 22*a*, and a first head section 22*c* provided at the other end portion of the first shaft section 22*a*. The second screw member 23 has a second shaft section 23*a*, a female screw section 23*b* provided at one end portion of the second shaft section 23*a* and screwed into the male screw section 22*b* of the first screw member 22, and a second head section 23*c* provided at the other end portion of the second shaft section 23*a*.

In this embodiment, the first screw member 22 is structured such that the outer diameter of the male screw section 22*b* is formed smaller than the outer diameter of the first shaft section 22*a*, and the outer diameter of the first head section 22*c* is formed slightly larger than the outer diameter of the first shaft section 22*a*, as shown in FIG. 4 and FIG. 5. The second screw member 23 is structured such that the outer diameter of the second shaft section 23*a* is formed to have the same size as the outer diameter of the first shaft section 22*a* of the first screw member 22.

Also, the second screw member 23 is structured such that the outer diameter of the female screw section 23*b* has the same size as the outer diameter of the second shaft section 23*a*, the female screw section 23*b* is formed in the tip end portion of the second shaft section 23*a*, and the outer diameter of the second head section 23*c* is formed slightly larger than the outer diameter of the second shaft section 23*a* and has the same size as the first head section 22*c* of the first screw member 22, as shown in FIG. 4.

Also, the coupling member 20 is formed such that the length of both of the axial-direction length of the first shaft section 22*a* and the axial-direction length of the second shaft section 23*a* is substantially the same as or slightly shorter than the axial-direction length of the attachment hole 11 of the band attachment section 10 when the male screw section 22*b* of the first screw member 22 is screwed into the female screw section 23*b* of the second screw member 23, as shown in FIG. 4 and FIG. 5. Moreover, the axial-direction length of each of the first head section 22*c* of the first screw member 22 and the second head section 23*c* of the second screw member 23 is formed slightly shorter than the axial-direction length of each of coupling holes 24 of the pair of coupling end sections 9*a* provided in the end portions 9 of the watch band 8.

In this embodiment, the inner diameter of the attachment hole 11 of the band attachment section 10 is formed to have a size that is substantially the same as each of the outer diameters of the first shaft section 22*a* of the first screw member 22 and the second shaft section 23*a* of the second screw member 23, as shown in FIG. 4 and FIG. 5. Also, the inner diameter of each of the coupling holes 24 of the pair of coupling end sections 9*a* positioned in the end portions 9 of the watch band 8 is formed to have a size that is substantially the same as each of the outer diameters of the first head section 22*c* of the first screw member 22 and the second head section 23*c* of the second screw member 23.

As a result, the coupling member 20 is structured to rotatably couple the end portions 9 of the watch band 8 with the band attachment section 10 by inserting the first shaft section 22*a* of the first screw member 22 into the attachment hole 11 of the band attachment section 10 from the coupling hole 24 of the coupling end section 9*a* of a first side of the watch band 8, inserting the second shaft section 23*a* of the second screw member 23 into the attachment hole 11 of the band attachment section 10 from the coupling hole 24 of the coupling end section 9*a* of a second side of the watch band 8, and screwing the male screw section 22*b* of the first screw member 22 into the female screw section 23*b* of the second screw member 23, as shown in FIG. 4 and FIG. 5.

Moreover, the coupling member 20 is structured such that, when the male screw section 22*b* of the first screw member 22 is screwed into the female screw section 23*b* of the second screw member 23 and tightened, the end portions 9 of the watch band 8 is reliably attached to the band attachment section 10 by the first head section 22*c* of the first screw member 22 coming in contact with one end portion of the band attachment section 10, the second head section 23*c* of the second screw member 23 coming in contact with the other end portion of the band attachment section 10, and both end portions of the band attachment section 10 being held between the first head section 22*c* of the first screw member 22 and the second head section 23*c* of the second screw member 23, as shown in FIG. 4 and FIG. 5.

Meanwhile, as shown in FIG. 4 and FIG. 5, the pair of fixing screws 21 is structured to be respectively screwed into the pair of coupling end sections 9*a* positioned in the end portions 9 of the watch band 8, in the direction orthogonal to the axial direction of the coupling member 20, and fix the coupling member 20. More specifically, the pair of fixing screws 21 is respectively screwed into screw holes 25 provided respectively in the pair of coupling end sections 9*a* of the watch band 8 in the direction orthogonal to the axial direction of the coupling member 20, and the tip end portions thereof hold the first head section 22*c* of the first screw member 22 and the second head section 23*c* of the second screw member 23.

In this embodiment, each of the pair of fixing screws 21 is a screw member having a projecting section 21*b* provided at one end portion that is a tip end portion of a screw section 21*a*, and a engaging section 21*c* provided at the other end portion of the screw section 21*a* and engages with a tool such as a driver, and these fixing screws 21 are structured not to have a head section, as shown in FIG. 4 and FIG. 5. Each fixing screw 21 is structured such that its axial-direction length is formed to have a length substantially the same as the axial-direction length of the screw hole 25 provided in each of the coupling end sections 9*a* of the watch band 8, and the projecting section 21*b* projects into the coupling hole 24 of the coupling end section 9*a* when the screw section 21*a* is screwed into the screw hole 25 of the coupling end section 9*a*.

Accordingly, on each of the first head section 22*c* of the first screw member 22 of the coupling member 20 and the second head section 23*c* of the second screw member 23, a position regulating groove 26 into which each of the projecting sections 21*b* of the pair of fixing screws 21 is inserted is annularly provided, as shown in FIG. 4 and FIG. 5. More specifically, the position regulating grooves 26 are structured to correspond to the screw holes 25 of the pair of coupling end sections 9*a* of the watch band 8 when the male screw section 22*b* of the first screw member 22 is screwed into the female screw section 23*b* of the second screw member 23 and both end portions of the band attachment section 10 are held between the first head section 22*c* and the second head section 23*c*.

As a result, the position regulating grooves 26 of the first head section 22*c* and the second head section 23*c* are structured such that, by the projecting sections 21*b* of the pair of fixing screws 21 being respectively inserted therein, the coupling member 20 in a state where the male screw section 22*b* of the first screw member 22 has been screwed into the female screw section 23*b* of the second screw member 23 regulates movement in the axial direction thereof so as to prevent the screwing of the male screw section 22*b* of the first screw member 22 into the female screw section 23*b* of the second screw member 23 from being loosened, as shown in FIG. 4 and FIG. 5.

Next, effects of the band attachment structure of this wristwatch are described.

When the watch band 8 is to be attached to the band attachment section 10 of the wristwatch case 1, first, the end portions 9 of the watch band 8 are arranged at the band attachment section 10. Here, the pair of coupling end sections 9*a* positioned in the end portions 9 of the watch band 8 is arranged on both sides of the band attachment section 10 so as to cause the coupling holes 24 provided in the pair of coupling end sections 9*a* to coaxially correspond to the attachment hole 11 of the band attachment section 10, as in the case of the first embodiment.

In this state, the first shaft section 22*a* of the first screw member 22 of the coupling member 20 is inserted into the attachment hole 11 of the band attachment section 10 from the coupling hole 24 of the first coupling end section 9*a* of the first side among the pair of coupling end sections 9*a*, and the second shaft section 23*a* of the second screw member 23 of the coupling member 20 is inserted into the attachment hole 11 of the band attachment section 10 from the coupling hole 24 of the coupling end section 9*a* of the second side. In this state, the male screw section 22*b* of the first screw member 22 is screwed into the female screw section 23*b* of the second screw member 23 and tightened.

As a result, the first head section 22*c* of the first screw member 22 comes in contact with one end portion of the band attachment section 10, and the second head section 23*c* of the second screw member 23 comes in contact with the other end portion of the band attachment section 10. As a result, both end portions of the band attachment section 10 are held between the first head section 22*c* of the first screw member 22 and the second head section 23*c* of the second screw member 23. Accordingly, the coupling member 20 is reliably and firmly fixed in the attachment hole 11 of the band attachment section 10 and the coupling holes 24 of the coupling end sections 9*a* provided in the end portions 9 of the watch band 8 without rattling, and the watch band 8 is rotatably attached to the band attachment section 10 of the wristwatch case 1 by the coupling member 20.

In this state, the position regulating grooves 26, which are provided respectively in the first head section 22*c* of the first screw member 22 and the second head section 23*c* of the second screw member 23, respectively correspond to the screw holes 25 of the pair of coupling end sections 9*a* provided in the end portions 9 of the watch band 8. In this state, the screw sections 21*a* of the fixing screws 21 are respectively screwed into the screw holes 25 of the pair of coupling end sections 9*a*, and the projecting sections 21*b* of the screw sections 21*a* are respectively inserted into the position regulating grooves 26 respectively provided on the first head section 22*c* and the second head section 23*c*.

As a result, the coupling member 20 in a state where the male screw section 22*b* of the first screw member 22 has been screwed into the female screw section 23*b* of the second screw member 23 is prevented from moving in the axial direction. Therefore, even when the attachment portion of the watch band 8 with respect to the wristwatch case 1 receives shock, the screwing of the male screw section 22*b* of the first screw member 22 into the female screw section 23*b* of the second screw member 23 is not loosened, and the pair of coupling end sections 9*a* provided in the end portions 9 of the watch band 8 is not pressed and widened. As a result, the watch band 8 is reliably and firmly attached to the band attachment section 10 of the wristwatch case 1 by the coupling member 20.

In this state, when the end portion 9 of the watch band 8 is rotated with respect to the band attachment section 10 of the wristwatch case 1, the end portion 9 of the watch band 8 is rotated around the first shaft section 22*a* of the first screw member 22 and the second shaft section 23*a* of the second screw member 23 of the coupling member 20. Therefore, the screwing of the male screw section 22*b* of the first screw member 22 into the female screw section 23*b* of the second screw member 23 is not loosened by friction between the attachment hole 11 of the band attachment section 10 and the coupling member 20 occurred along with the rotation. Accordingly, the watch band 8 is rotatably attached to the band attachment section 10 of the wristwatch case 1 reliably and firmly by the coupling member 20.

As such, in the band attachment structure of the wristwatch, even when the attachment portion of the watch band 8 with respect to the wristwatch case 1 receives shock, the coupling member 20 is not loosened and the pair of coupling end sections 9*a* provided in the end portions 9 of the watch band 8 is not pressed and widened because the coupling member 20 has been fixed by the fixing screws 21. Since the coupling member 20 is not detached from the band attachment section 10 of the wristwatch case 1 and the end portions 9 of the watch band 8, the end portions 9 of the watch band 8 can be reliably and firmly attached to the band attachment section 10 by the coupling member 20, as in the case of the first embodiment.

In the band attachment structure of the wristwatch of this embodiment as well, even if the increase of the size of the display surface of the wristwatch, that is, face widening is desired, and whereby the sizes of the wristwatch case 1 and the watch band 8 and the weight of the entire wristwatch are increased and impact force caused by the wristwatch being dropped or the like is increased, the coupling member 20 is not loosened and detached by the increased impact force. Therefore, even when the sizes of the wristwatch case 1 and the watch band 8 are increased, the watch band 8 can be reliably and firmly attached to the band attachment section 10 by the coupling member 20.

In this embodiment, the coupling member 20 includes the first screw member 22 having the male screw section 22*b* and the second screw member 23 having the female screw section 23*b* screwed into the male screw section 22*b* of the first screw member 22. As a result, the end portions 9 of the watch band 8 and the band attachment section 10 can be easily coupled only by inserting the first screw member 22 and the second screw member 23 into the attachment hole 11 of the band attachment section 10 from the coupling holes 24 of the pair of coupling end sections 9*a* positioned in the end portions 9 of the watch band 8, and screwing the male screw section 22*b* into the female screw section 23*b*.

That is, the first screw member 22 is structured such that the male screw section 22*b* is provided at one end portion of the first shaft section 22*a* and the first head section 22*c* is provided at the other end portion of the first shaft section 22*a*, and the second screw member 23 is structured such that the female screw section 23*b* is provided at one end portion of the second shaft section 23*a* and the second head section 23*c* is provided at the other end portion of the second shaft section 23*a*. Accordingly, when the male screw section 22*b* is screwed into the female screw section 23*b* and tightened in the attachment hole 11 of the band attachment section 10, both end portions of the band attachment section 10 can be held between the first head section 22*c* of the first screw member 22 and the second head section 23*c* of the second screw member 23.

Since the first screw member 22 and the second screw member 23 are reliably and firmly attached in the coupling holes 24 of the pair of coupling end sections 9*a* in the end portions 9 of the watch band 8 and the attachment hole 11 of the band attachment section 10 without rattling, the watch band 8 can be rotatably attached to the band attachment section 10 of the wristwatch case 1 reliably by the coupling member 20.

Also, in this band attachment structure, the pair of fixing screws 21 is screwed into the pair of coupling end sections 9*a* positioned in the end portions 9 of the watch band 8, in the direction orthogonal to the axial direction of the coupling member 20, and thereby fixes the coupling member 20. Therefore, when shock is received, the screwing of the male screw section 22*b* of the first screw member 22 into the female screw section 23*b* of the second screw member 23 of the coupling member 20 is not loosened, and the first screw member 22 and the second screw member 23 are not detached, whereby the watch band 8 can be prevented from being unintentionally detached from the band attachment section 10.

In this embodiment, the position regulating grooves 26 into which the pair of fixing screws 21 is inserted are provided on the outer peripheries of both end portions of the coupling member 20, respectively. Accordingly, the coupling member 20 can reliably prevent movement in the axial direction. Therefore, even when the attachment portion of the watch band 8 with respect to the wristwatch case 1 receives shock, the coupling of the coupling member 20 is not loosened and the pair of coupling end sections 9*a* provided in the end portions 9 of the watch band 8 is not pressed and widened. As a result, the state where the watch band 8 has been attached to the band attachment section 10 can be reliably and favorably maintained.

That is, each of the pair of fixing screws 21 has the projecting section 21*b* at the tip end portion of the screw section 21*a*, and the position regulating grooves 26 are located in portions of the first head section 22*c* and the second head section 23*c* which correspond to the screw holes 25 of the pair of coupling end sections 9*a* of the watch band 8 when the male screw section 22*b* of the first screw member 22 is screwed into the female screw section 23*b* of the second screw member 23 and both end portions of the band attachment section 10 are held between the first head section 22*c* and the second head section 23*c*. Therefore, the projecting sections 21*b* of the pair of fixing screws 21 can be reliably inserted into the position regulating grooves 26 of the first head section 22*c* and the second head section 23*c*.

In this embodiment, when the screw sections 21*a* of the pair of fixing screws 21 are screwed into the screw holes 25 of the pair of coupling end sections 9*a*, the projecting sections 21*b* of the screw sections 21*a* can be projected into the coupling holes 24 of the pair of coupling end sections 9*a* and respectively inserted into the position regulating grooves 26 of the first head section 22*c* and the second head section 23*c*. That is, the projecting sections 21*b* of the pair of fixing screws 21 can be easily inserted into the position regulating grooves 26 of the first head section 22*c* and the second head section 23*c*, and the first screw member 22 and the second screw member 23 of the coupling member 20 can be reliably prevented from moving in the axial direction.

Accordingly, when the end portion 9 of the watch band 8 is rotated with respect to the band attachment section 10, the end portion 9 of the watch band 8 can be rotated around the first shaft section 22*a* of the first screw member 22 and the second shaft section 23*a* of the second screw member 23 of the coupling member 20. Therefore, even when friction is generated at the attachment hole 11 of the band attachment section 10 and the coupling member 20 along with the rotation, the screwing of the male screw section 22*b* of the first screw member 22 into the female screw section 23*b* of the second screw member 23 is not loosened. As a result, the watch band 8 can be rotatably attached to the band attachment section 10 of the wristwatch case 1 reliably and firmly by the coupling member 20.

In the above-described second embodiment, the fixing screws 21 are screwed into the pair of coupling end sections 9*a* positioned in the end portions 9 of the watch band 8, in the direction orthogonal to the axial direction of the coupling member 20, and fix the coupling member 20. However, the present invention is not limited thereto, and a structure may be adopted in which the first screw member 22 and the second screw member 23 of the coupling member 20 are fixed by the fixing screws 16 screwed into the coupling holes 12 of the pair of coupling end sections 9*a* along the axial direction, as in the case of the first embodiment.

In this structure as well, it is preferable that the buffers 17 are arranged between both end portions of the coupling member 20 and the pair of fixing screws 16, that is, between the first head section 23*c* of the first screw member 22 and one fixing screw 16 and between the second head section 23*c* of the second screw member 23 and the other fixing screw 16.

Also, in the above-described first embodiment, the fixing screws 16 are screwed into the coupling holes 12 of the pair of coupling end sections 9*a* in the end portions 9 of the watch band 8 along the axial direction, and thereby fix the pair of screw members 15 of the coupling member 13. However, the present invention is not limited thereto, and a structure may be adopted in which the fixing screws 21 are screwed into the pair of coupling end sections 9*a* positioned in the end portions 9 of the watch band 8, in the direction orthogonal to the axial direction of the coupling member 13, and fix the head sections 15*b* of the pair of screw members 15, as in the case of the second embodiment. In this structure as well, it is preferable that the position regulating grooves 26 into which the projecting sections 21*b* of the fixing screws 21 are inserted are respectively provided on the outer peripheral portions of the pair of screw members 15 of the coupling member 13.

Also, in the above-described first and second embodiments, the pair of coupling end sections 9*a* positioned in the end portions 9 of the watch band 8 straddles the band attachment section 10 provided on the wristwatch case 1 and is arranged on both sides thereof. However, the present invention is not limited thereto, and a structure may be adopted in which a pair of attachment sections positioned in both end portions of the band attachment section 10 straddles one end portion 9 of the watch band 8 and is arranged on both sides of the end portion 9 of the watch band 8.

In this case, it is preferred to adopt a structure in which a coupling hole having the same structure as the attachment hole 11 provided in the band attachment section 10 of the first and second embodiments is provided in the end portions 9 of the watch band 8, and attachment holes having the same structures as the coupling holes 12 and 24 provided in the pair of coupling end sections 9*a* of the end portions 9 of the watch band 8 in the first and second embodiments are provided in a pair of attachment sections positioned at both end portions of the band attachment section 10.

Moreover, in the above-described first and second embodiments, the present invention has been applied in a wristwatch. However, the present invention is not necessarily required to be applied in a wristwatch. For example, the present invention can be applied in electronic devices such as blood-pressure meters, pulse meters, and the like which are worn on a body part such as an arm, and can also be applied in briefcases, bags, and the like.

While the present invention has been described with reference to the preferred embodiments, it is intended that the invention be not limited by any of the details of the description therein but includes all the embodiments which fall within the scope of the appended claims.

What is claimed is:

1. A wristwatch comprising:

a case including a band attachment section having an attachment hole;

a band including a coupling hole in one end portion located coaxially with the attachment hole of the band attachment section;

a coupling member inserted into the coupling hole of the band and the attachment hole of the band attachment section and coupling the band with the band attachment section; and a fixing member fixing the coupling member to the attachment hole of the band attachment section or the coupling hole of the band, wherein the coupling member comprises a tubular member having a female screw on an inner peripheral surface and inserted into the coupling hole of the band and the attachment hole of the band attachment section, and a pair of screw members each having a male screw screwed into the female screw of the tubular member and a head section larger than an outer diameter of the tubular member.

2. The wristwatch according to claim 1, wherein the end portion of the band comprises a pair of coupling end sections arranged on both sides of the band attachment section in a manner to straddle the band attachment section, and wherein the coupling hole is provided in each of the pair of coupling end sections.

3. The wristwatch according to claim 1, wherein the band attachment section comprises a pair of attachment sections arranged on both sides of the end portion of the band in a manner to straddle the end portion, and wherein the attachment hole is provided in each of the pair of attachment sections.

4. The wristwatch according to claim 1, wherein the end portion of the band comprises a pair of coupling end sections arranged on both sides of the band attachment section in a manner to straddle the band attachment section, and wherein each coupling hole in the pair of coupling end sections comprises a small-diameter hole section into which the tubular member is inserted, and a large-diameter hole section into which the head section of the screw member is inserted.

5. The wristwatch according to claim 1, wherein the coupling member comprises a first screw member having a male screw section, and a second screw member having a female screw section into which the male screw section of the first screw member is screwed.

6. The wristwatch according to claim 2, wherein the coupling member comprises a first screw member having a male screw section, and a second screw member having a female screw section into which the male screw section of the first screw member is screwed.

7. The wristwatch according to claim 3, wherein the coupling member comprises a first screw member having a male screw section, and a second screw member having a female screw section into which the male screw section of the first screw member is screwed.

8. The wristwatch according to claim 1, wherein the fixing member is a fixing screw screwed into the attachment hole of the band attachment section or the coupling hole of the band along an axial direction so as to fix the coupling member.

9. The wristwatch according to claim 2, wherein the fixing member is a fixing screw screwed into the attachment hole of the band attachment section or the coupling hole of the band along an axial direction so as to fix the coupling member.

10. The wristwatch according to claim 3, wherein the fixing member is a fixing screw screwed into the attachment hole of the band attachment section or the coupling hole of the band along an axial direction so as to fix the coupling member.

11. The wristwatch according to claim 8, wherein a buffer is arranged between the fixing screw and the coupling member.

12. The wristwatch according to claim 9, wherein a buffer is arranged between the fixing screw and the coupling member.

13. The wristwatch according to claim 10, wherein a buffer is arranged between the fixing screw and the coupling member.

14. A wristwatch comprising:

a case including a band attachment section having an attachment hole;

a band including a coupling hole in one end portion located coaxially with the attachment hole of the band attachment section;

a coupling member inserted into the coupling hole of the band and the attachment hole of the band attachment section and coupling the band with the band attachment section; and a fixing member fixing the coupling member to the attachment hole of the band attachment section or the coupling hole of the band, wherein the fixing member is a fixing screw screwed into the band attachment section or the end portion of the band in a direction orthogonal to an axial direction of the coupling member so as to fix the coupling member.

15. The wristwatch according to claim 14, wherein an outer periphery of the coupling member has a position regulating groove into which the fixing screw is inserted.

* * * * *